US005141778A

United States Patent [19]

Yarkosky et al.

[11] Patent Number: 5,141,778

[45] Date of Patent: Aug. 25, 1992

[54] METHOD OF PREPARING ALUMINUM MEMORY DISKS HAVING A SMOOTH METAL PLATED FINISH

[75] Inventors: Eugene F. Yarkosky, Milford; Patricia A. Cacciatore, Prospect, both of Conn.

[73] Assignee: Enthone, Incorporated, West Haven, Conn.

[21] Appl. No.: 644,859

[22] Filed: Jan. 23, 1991

Related U.S. Application Data

[63] Continuation of Ser. No. 420,805, Oct. 12, 1989, abandoned.

[51] Int. Cl.[5] ..... C23C 26/00

[52] U.S. Cl. ..... 427/304; 427/306; 427/305; 427/438

[58] Field of Search ..... 427/304, 306, 305, 438

[56] References Cited

U.S. PATENT DOCUMENTS

| | | | |
|---|---|---|---|
| 2,679,475 | 5/1954 | Singler | 427/438 |
| 2,929,742 | 3/1960 | Minjer | 427/438 |
| 2,935,425 | 5/1960 | Gutzeit | 427/438 |
| 3,202,529 | 8/1965 | Dunlap | 427/438 |
| 3,565,667 | 2/1971 | Klingspor | 427/304 |
| 4,346,128 | 8/1982 | Loch | 427/438 |
| 4,482,596 | 11/1984 | Gulla | 427/443.1 |
| 4,567,066 | 1/1986 | Schultz | 427/438 |
| 4,659,605 | 4/1987 | Malik | 427/132 |
| 4,670,312 | 6/1987 | Ehrsam | 427/436 |

FOREIGN PATENT DOCUMENTS

| | | | |
|---|---|---|---|
| 125352 | 1/1984 | European Pat. Off. | 427/304 |
| 1254935 | 11/1967 | Fed. Rep. of Germany | 427/438 |
| 1030673 | 2/1986 | Japan | 427/304 |
| 1330206 | 8/1987 | Japan | 427/304 |

OTHER PUBLICATIONS

D. S. Lashmore, "Immersion Coatings on Aluminum" Plating and Surface Finishing. Jan., 1980, pp. 37–42.

John J. Kuezma "You Can Produce Quality Electroless Nickel on Aluminum" Products Finishing. Sep. 1973. pp. 48–56.

"The Electromotive Series for Metals and Alloys" Metal Finishing, vol. 50, No. 4, Apr. 1952 p. 89.

*Primary Examiner*—Shrive Beck

*Assistant Examiner*—Vi Duong Dang

*Attorney, Agent, or Firm*—John J. Tomaszewski

[57] ABSTRACT

A method for producing extremely smooth metal coatings on zincated aluminum substrates using a special double zincating procedure and/or a specially formulated electroless metal plating bath employing a unique plating process.

7 Claims, 6 Drawing Sheets

METHOD OF PREPARING ALUMINUM MEMORY DISKS HAVING A SMOOTH METAL PLATED FINISH

This is a continuation of copending application Ser. No. 07/420,805 filed on Oct. 12, 1989 now abandoned.

BACKGROUND OF THE INVENTION

This invention relates to the metal plating of zincated aluminum and, more particularly, to providing an enhanced adhesive and smooth plating by employing an improved double zincating process and preferably, in combination with a unique electroless metal plating procedure utilizing a specially formulated electroless metal plating bath.

Metal plating of aluminum is of considerable commercial interest and one application is the preparation of memory disks which are used in a variety of electronic applications such as computer and data processing systems. Aluminum is the preferred substrate for the disk although other suitable metals may be employed. In general, a relatively thin layer of nonmagnetic electroless nickel is applied on the aluminum followed by a thin layer of a magnetic material such as cobalt. A signal is stored on the disk by magnetizing the cobalt layer to represent the signal at a selected moment in time.

Typical alloys used for memory disks are Aluminum Association Numbers 5086 and 5586. These disks contain magnesium in an amount of about 4% by weight. Generally, the aluminum disks are about 1.25 to 5 mm. thick and contain, by weight, about 4% to 4.90% magnesium, 0.01% to 0.40% copper, 0.01% to 0.40% zinc, chromium, nickel, iron, silicon and the balance aluminum and inevitable impurities.

The completed metal plated disk must be extremely smooth and uniform so as to prevent "crashing" against the magnetizing head of the device which flies extremely close (generally 5-8 microinches) to the disk surface. While the starting aluminum substrate must itself be extremely smooth and flat as described in U.S. Pat. No. 4,825,680, the metal plating of the disk must likewise be smooth and uniform so that the final disk product meets the exacting specifications required of these type products.

Unfortunately, however, metal plating of a substrate, and even electroless metal plating, does not necessarily produce a smooth coating. Plating voids, inclusions, bridging and the like are only some of the plating problems which can cause a rough disk surface which is unacceptable.

Aluminum and its alloys also present additional plating problems because of the rapidity with which they form an oxide coating when exposed to air. As a result, special treatments must be employed when plating on aluminum. These treatments include mechanical treatments; chemical etches, especially acid etches containing iron, nickel, and manganese salts; alkaline displacement solutions, especially those depositing zinc, brass, and copper; anodizing, especially in phosphoric, sulfuric or chromic acids; and electroplating with zinc at low current densities for a few seconds. Of these treatments, the alkaline displacement solutions are generally the most successful commercially.

While many metals can be deposited on aluminum by displacement, zinc is the most common. In this case, the process is known as the zincate process.

During the years a number of improvements have been made in the conventional zincate formulation and zincating process, with most of them aimed at accelerating the rate of film formation, and the degree of adhesion and uniformity of the zinc coating produced. A detailed summary of the zincating process may be found in Loch, U.S. Pat. No. 4,346,128, and Saubestre, U.S. Pat. No. 3,216,835, which patents are hereby incorporated by reference.

In the conventional zincating process, the aluminum is prepared by alkaline cleaning to remove organic and inorganic surface contaminations such as oil and grease, followed by a cold water rinse. The cleaned aluminum is then sufficiently etched to eliminate solid impurities and alloying constituents which might create voids resulting in bridging of subsequent deposits. After a water rinse, the aluminum is de-smutted to remove metallic residues and aluminum oxides still remaining on the surface. Thorough rinsing is required and then the zincate coating is applied using an immersion zinc bath to prevent re-oxidation of the cleaned surface.

The zinc coating is obtained by immersion of the aluminum part in an alkaline solution containing zincate ions. The amount of zinc deposited is actually very small and depends on the time and type of immersion bath used, the aluminum alloy, temperature of the solution and the pretreatment process. The zinc coating bath also functions as an etching solution and any oxides reformed during the transferring operations are dissolved by the alkaline zincate while depositing zinc onto the aluminum.

The general procedure now followed by industry is to double zincate whereby the first zinc film is removed using nitric acid followed by application of a second immersion zinc deposit. Double zincating is a preferred method for plating aluminum and is especially useful on certain difficult-to-plate aluminum alloys to ensure better adhesion of the final metal layer deposit.

Despite the acceptance and effectiveness of the double zincating process, the need still exists for an improved process providing both enhanced adhesion and smoothness of the metal plating on the zincated aluminum substrate. Without being limited to theory, it is believed that the properties of the metal plate are directly related to the thickness, uniformity and continuity of the zincate coating with thinner coatings generally providing a smoother and more adhesive metal plating.

It is an object of the present invention to provide a method for preparing aluminum substrate articles having extremely smooth metal plated coatings.

It is a further object of the present invention to provide an improved double zincating process for the metal plating of aluminum, which improved process provides a thinner more uniform and continuous zincate coating and produces enhanced adhesive metal plating deposits and metal plating smoothness.

Another object of the invention is to provide an improved electroless metal plating composition and plating method for coating zincated aluminum substrates with extremely smooth coatings.

Other objects and advantages will become apparent from the following detailed description.

SUMMARY OF THE INVENTION

It has been found that extremely smooth metal plated aluminum substrates, e.g., memory disks, can be made by preferably employing a special double zincating process in conjunction with an electroless metal plating bath containing an effective amount of cadmium. The double zincating process for preparing aluminum and aluminum alloys for metal plating is improved by utilizing a specially formulated $HNO_3$ bath to strip the first zincate film from the aluminum. Following conventional procedures, the stripped aluminum is then water rinsed and coated with a second zincate film. The metal is plated on this second zincate film. Broadly stated, the $HNO_3$ bath used to strip the zincate coating comprises Group VIII ions and, preferably ferric ions, in an effective amount, for example, of about 0.1 g/l to 2 g/l and $HNO_3$ in an amount of about 250 or 350 to 600 g/l or higher.

Following the zincate procedure, the electroless metal, e.g., nickel, plating of the aluminum is improved by employing an electroless metal plating bath containing an effective amount of cadmium to provide extremely smooth metal coatings. Broadly stated, the electroless metal bath contains (1) a source of metal ions, (2) a reducing agent such as hypophosphite or an amine borane, (3) an acid or hydroxide pH adjustor to provide the required pH, (4) a complexing agent for metal ions sufficient to prevent their precipitation in solution and (5) an effective amount of cadmium ions to provide the extremely smooth coating of the invention. In general, the cadmium level is about 0.1 to 1 mg/l, with a preferred level being about 0.4 to 0.7 mg/l.

It has been found that the consumption of the cadmium occurs rapidly in the first stages of plating, i.e., 10 minutes and thereafter the consumption is very slow and the presence of the cadmium is not important during further plating. A preferred mode of operation is to start the plating of the zincated aluminum substrate in an electroless bath containing an effective amount of cadmium, about 0.1 to 1 mg/l, and not to replenish the cadmium until new zincated substrates are to be plated in the bath. The electroless metal plating bath contains metal ions, reducing agents, chelators, etc., and these components are conventionally replenished by measuring the concentration of the component and adding more of the component, as needed, to maintain the level between desired operating limits. New plating methods use automatic controllers which continually measure and replenish the bath components. Other methods, such as manual measuring and replenishment at certain intervals, e.g., hourly, etc., may also be employed.

In a highly preferred embodiment, multiple plating baths are employed whereby a thin coating of nickel is provided on the zincated surface from an electroless bath containing cadmium ions followed by plating a thicker, final coating from a second conventional electroless plating bath. This preferred process is similar to the process described in U.S. Pat. No. 4,567,066 granted to P. B. Schultz and E. F. Yarkosky, which patent is hereby incorporated by reference.

DETAILED DESCRIPTION OF THE INVENTION

Figure 1A:
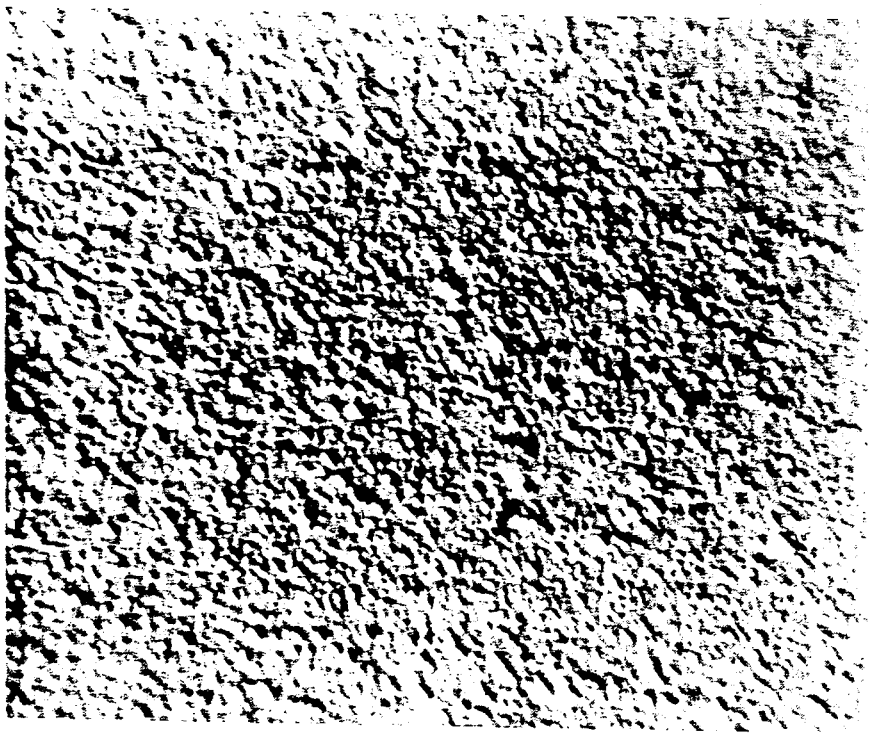
FIGS. 1A and 2A are photomicrographs at 500X of electrolessly nickel plated aluminum substrates which were prepared for plating by a conventional double zincate process.

The double zincate method for preparing aluminum for metal plating is well-known in the art as discussed hereinabove. In general, any aluminum or aluminum alloy may be treated using the method of the invention and exemplary alloys are 5086, 5586 and CZ-46. The aluminum may be wrought or cast.

While the specific double-zincate method employed may vary according to the alloys treated and the claimed results, all the methods use a $HNO_3$ acid dip to remove the first zincate film and this is the step that the present invention is directed to. A typical procedure used in industry is as follows and it should be understood that water rinses are generally employed after each processing step.

The first step is usually to clean the aluminum surface of grease and oil and an alkaline nonetch cleaner such as ENBOND (R) NS-35 sold by Enthone, Incorporated, West Haven, Conn., may be suitably employed. ENBOND NS-35 is a nonsilicated mildly alkaline cleaner used over a temperature range of about 49° to 66° C. for 1 to 5 minutes.

Etching of the cleaned aluminum may then be performed using etchants such as ACTANE (R) E-10, ENBOND E-14 or ENBOND E-24, all of which are sold by Enthone. These materials are either acidic or alkaline. The acid etchant is generally preferred particularly when surface dimensions, tolerances and integrity are important. The etchants are generally used at elevated temperatures of about 49° to 66° C. for 1 to 3 minutes.

De-smutting of the alloy may be performed using a $HNO_3$ solution (for example 50% by volume) or mixtures of $HNO_3$ and $H_2SO_4$ alone or in combination with ACTANE 70 sold by Enthone. ACTANE 70 is an acidic, fluoride salt product containing ammonium bifluoride. A typical de-smutting solution contains 25% by volume $H_2SO_4$50% by volume HN03 and 1 lb./gallon ACTANE 70 in water.

It is at this point that a zincate coating is applied to the aluminum by immersion in a zincate bath as described in Saubestre, U.S. Pat. No. 3,216,835, supra. A preferred bath due to its demonstrated effectiveness is ALUMON® EN sold by Enthone. ALUMON EN contains an alkali metal hydroxide, a zinc salt (such as zinc oxide, zinc sulfate, etc.), a chelating agent, optionally anionic wetting agents and metallic additives. An article by D. S. Lashmore entitled "Immersion Coatings on Aluminum", Plating and Surface Finishing, 67, pages 36–42 (1980) shows the use of iron (e.g., ferric chloride) in the zincate solution to deposit iron along with the zinc and produce a more adhesive zincate coating which is very resistant and comparatively insoluble in $HNO_3$. ALUMON® EN and other commercial zincate solutions contain iron.

Generally, the double zincate process involves immersion of the aluminum substrate in a dilute zincate bath such as an ALUMON ® EN for a period of 20-50 seconds followed by a thorough cold water rinse, a zinc stripping operation in nitric acid, a further cold water rinse, and a second zincate immersion and subsequent rinse. As noted in Loch, U.S. Pat. No. 4,346,128, supra, the improved Loch process soaks the zincated work piece in nitric acid for from one to three minutes instead of the usual 20-30 seconds used to strip the zincate coating. This procedure purportedly produces a thin uniform oxide coating on the substrate that serves to further reduce zinc deposition rates and to thereby provide better zincate adhesion for the final (second) zincate coating.

In contrast to the Loch procedure, the use of Group VIII ions, e.g., ferric ions, in the nitric acid bath accomplishes the similar result of reducing zinc deposition rates while providing a zincate coating which is very adhesive, uniform and continuous and on which an extremely smooth metal plating may be coated.

With regard to the improvement of the invention, the nitric acid solution used to strip the first zincate coating is generally a 50% by volume solution with a range of concentration being generally about 350 to 600 g/l, and preferably about 450 to 550 g/l. The improved solution also contains Group VIII ions, preferably ferric ions, in an amount of about 0.1 g/l to 1 or 2 g/l, preferably 0.3 g/l to 0.8 g/l and most preferably 0.4 g/l to 0.6 g/l. At levels below about 0.1 g/l, minimal effects are obtained while at levels above about 2 g/l, the surface topography may be severely affected.

The nitric acid solution may be employed at any suitable temperature, usually about 20° to 25° C. or higher and preferably 21° to 23° C. Immersion times may vary from about 30 to 90 seconds and preferably about 40 to 60 seconds.

Exemplary Group VIII ions which may be employed include iron, nickel and cobalt. Ferric ions are particularly preferred.

It will be understood by those skilled in the art that the concentration, solution temperature and immersion time are interrelated and that, in general, the higher the temperature and concentration, the shorter the immersion time necessary to achieve the desired surface effect, with the invention residing in the use of Group VIII ions in the bath to provide the enhanced adhesion and smoothness of the metal plating.

While other metals may now be plated on the specially prepared zinc coated aluminum, the following description will be specifically directed to nickel because of its commercial importance.

Electroless nickel plating compositions for applying the nickel coatings are well known in the art and plating processes and compositions are described in numerous publications. For example, compositions for depositing electroless nickel are described in U.S. Pat. Nos. 2,690,401; 2,690,402; 2,762,723; 2,935,425; 2,929,742; and 3,338,726. Other useful compositions for depositing nickel and its alloys are disclosed in the 35th Annual Edition of the Metal Finish Guidebook for 1967, Metal and plastics publications Inc., Westwood, N.J., pages 483-486. Each of the foregoing publications are included herein by reference.

In general, electroless nickel deposition solutions comprise at least four ingredients dissolved in a solvent, typically water. They are (1) a source of the nickel ions, (2) a reducing agent such as a hypophosphite or an amine borane, (3) an acid or hydroxide pH adjustor to provide the required pH and (4) a complexing agent for metal ions sufficient to prevent their precipitation in solution. A large number of suitable complexing agents for electroless nickel solutions are described in the above noted publications. It will be appreciated by those skilled in the art that the nickel, or other metal being applied, is usually in the form of an alloy with the other materials present in the bath. Thus, if hypophosphite is used as the reducing agent, the deposit will contain nickel and phosphorous. Similarly, if an amine borane is employed, the deposit will contain nickel and boron. Thus, use of the term nickel includes the other elements normally deposited therewith.

The nickel ion may be provided by the use of any soluble salt such as nickel sulfate, nickel chloride, nickel acetate and mixtures thereof. The concentration of the nickel in solution may vary widely and is about 0.1 to 100 g/l, preferably about 2 to 50 g/l, e.g., 2 to 10 g/l.

The reducing agent, especially for memory disks, is usually the hypophosphite ion supplied to the bath by any suitable source such as sodium, potassium, ammonium and nickel hypophosphite. Other reducing agents such as amine boranes, borohydrides and hydrazine may also suitably be employed The concentration of the reducing agent is generally in excess of the amount sufficient to reduce the nickel in the bath.

The baths may be acid, neutral or alkaline and the acid or alkaline pH adjustor may be selected from a wide range of materials such as ammonium hydroxide, sodium hydroxide, hydrochloric acid and the like. The pH of the bath may range from about 2 to 12, with acid baths being preferred. A pH range of 4 to 5, e.g., 4.3 to 4.6, being preferred for the cadmium containing bath used to deposit the coating on the zincate layer. A range of 4 to 5, e.g., 4.3 to 4.6 is also preferred for the bath used to deposit the final layer of nickel when the cadmium containing bath is used to provide only a thin, strike coating.

The complexing agent may be selected from a wide variety of materials such as lactic acid, malic acid and those containing anions such as acetate, citrate, glycollate, pyrophosphate and the like, with mixtures thereof being suitable. Ranges for the complexing agent, based on the anion, may vary widely, for example, about 1 to 300 g/l, preferably about 5 to 50 g/l.

The electroless nickel plating baths may also contain other ingredients known in the art such as buffering agents, bath stabilizers, rate promoters, brighteners, etc. Stabilizers such as lead, antimony, mercury, tin and oxy compounds such as iodate may be employed.

A suitable bath may be formed by dissolving the ingredients in water and adjusting the pH to the desired range.

The zinc coated aluminum part may be plated with the electroless nickel-cadmium bath to the desired final thickness. Preferably, the part is immersed in the bath to plate a thin nickel coating adequate to provide a suitable base for the extremely smooth thick deposits of the final nickel plate using a different electroless nickel bath. Thicknesses may range up to about 0.1 mil, or higher, with 0.005 to 0.08 mils, e.g., 0.01 to 0.05, being preferred. An immersion time of 15 seconds to 15 minutes usually provides the desired coating, depending on bath parameters. A temperature range of about 25 to boiling, e.g., 100° C., may be employed, with a range of about 30° to 95° C. being preferred.

The next step in the preferred procedure is to complete the nickel plating to the desired thickness and physical characteristics by immersing the nickel coated part in another electroless nickel plating bath which is maintained over a temperature range of about 30° to 100° C., e.g., boiling, preferably 80° to 95° C. A thickness up to 5 mils, or higher may be employed, with a range of about 0.1 to 2 mils being used for most applications. When this strike bath process is used, it is preferred not to rinse the strike coated substrate before immersing the substrate in the next (final) plating bath.

The cadmium ions may be provided by the use of any soluble cadmium source such as cadmium sulfate. It is important to control the cadmium concentration to obtain the extremely smooth coatings of the invention and an effective level of about 0.1 to 1 mg/l, preferably 0.3 to 0.8 and most preferably 0.5 to 0.7 may suitably be employed. Amounts as high as 2 or 3 mg/l or higher may be used for certain applications not requiring as smooth a surface as for memory disks.

The use of cadmium in electroless nickel plating baths is described in U.S. Pat. No. 2,929,742. Cadmium is disclosed as affecting the hydrogen overvoltage and is considered beneficial to improving the brightness of the deposit. Amounts of up to 100 mg/l cadmium chloride are shown.

It will be appreciated by those skilled in the art that the rate of plating may be influenced by many factors including (1) pH of the plating solution, (2) concentration of reductant, (3) temperature of the plating bath, (4) concentration of soluble nickel, (5) ratio of the volume of bath to the area plated, (6) presence of soluble fluoride salts (rate promoters) and (7) presence of wetting agent and/or agitation, and that the above parameters are only provided to give general guidance for practising the invention; the invention residing in the use of a cadmium containing electroless plating bath as hereinbefore described to provide an enhanced smooth coating on a zincated aluminum substrate.

The composition and process of the present invention will now be more fully illustrated by the following specific examples which are illustrative and in no way limitative and wherein all parts and percentages are by weight and temperatures in degrees centigrade unless otherwise noted.

EXAMPLE I

CZ-46 aluminum alloy disks were double zincated and plated with electroless nickel using the following procedure (a cold water rinse followed each of the (1) Immerse in ENBOND NS-35 for 3 minutes at 60° C.;

(2) Immerse in ACTANE E-10 for 1 minute at 60° C.;

(3) Immerse in 50% by volume $HNO_3$ for 1 minute at room temperature;

(4) Immerse in ALUMON EN for 35 seconds at room temperature;

(5) Immerse in 50% by volume $HNO_3$ for 1 minute at room temperature;

(6) Immerse in ALUMON EN for 16 seconds at room temperature;

(7) Immerse in ENPLATE ADP-300 for 1 hour at 84°-87° C. (pH 4.5±0.1).

ENPLATE ADP-300 is an acidic based (pH 4.6) electroless nickel bath containing, in g/l, nickel sulfate hexahydrate (26), sodium hypophosphite (20), sodium lactate (60%) (71), malic acid (11.8), sodium hydroxide (4.6), potassium iodate (0.015), lead nitrate (0.0003) and an anionic surfactant (0.02).

Figure 1B:
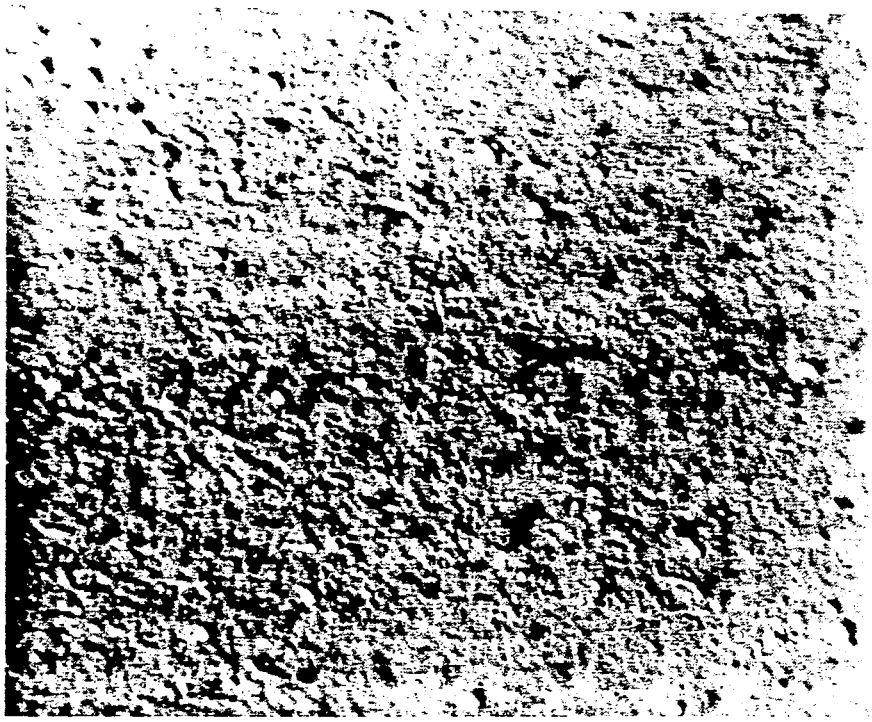
FIGS. 1B and 2B are photomicrographs at 500X of electrolessly nickel plated aluminum substrates which were prepared for plating by the double zincate process of the present invention.

FIG. 1A shows the nickel surface resulting from using the above conventional double zincating procedure. When the same procedure was used except that ferric ions (as ferric chloride) were added to the $HNO_3$ in step (5) at a level of 0.5 g/l $Fe^{+++}$, a markedly smoother nickel surface was obtained as shown by FIG. 1B.

EXAMPLE II

The procedure of EXAMPLE I was essentially repeated on 5586 aluminum alloy disks as follows:

(1) Immerse in ENBOND NS-35 for 5 minutes at 63° C.;

(2) Immerse in ACTANE E-10 for 2 minutes at 63° C.;

(3) Immerse in 50% by volume $HNO_3$ for 1 minute at room temperature;

(4) Immerse in ALUMON EN for 45 seconds at room temperature;

(5) Immerse in 50% by volume $HNO_3$ for 30 seconds at room temperature;

(6) Immerse in ALUMON EN for 15 seconds at room temperature;

(7) Immerse in ENPLATE ADP-300 for 2 hours at 84°-87° C. (pH 4.5±0.1).

Figure 2A:
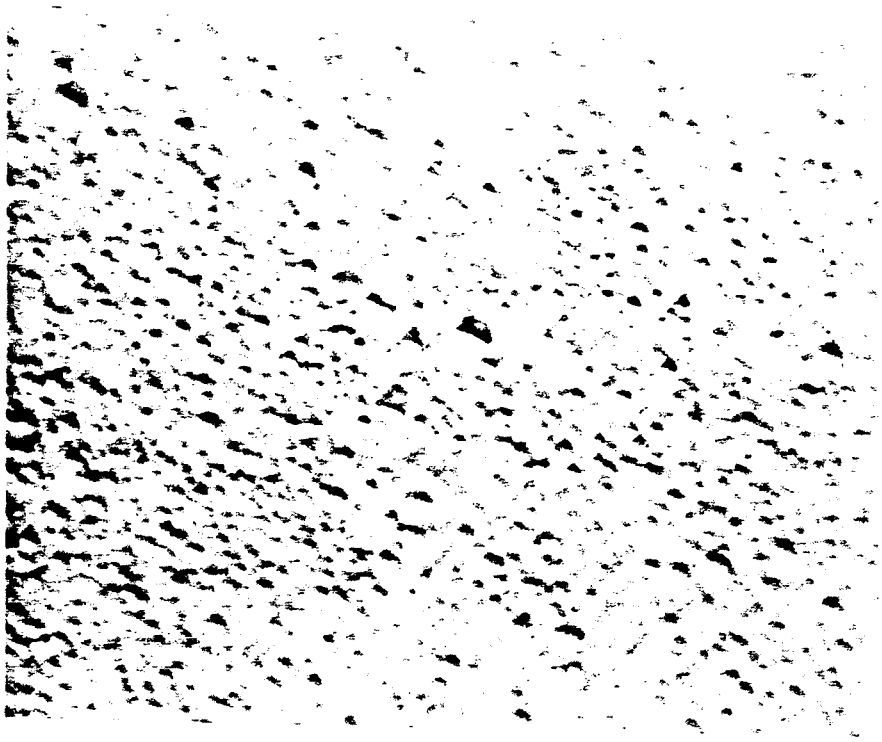
Figure 2B:
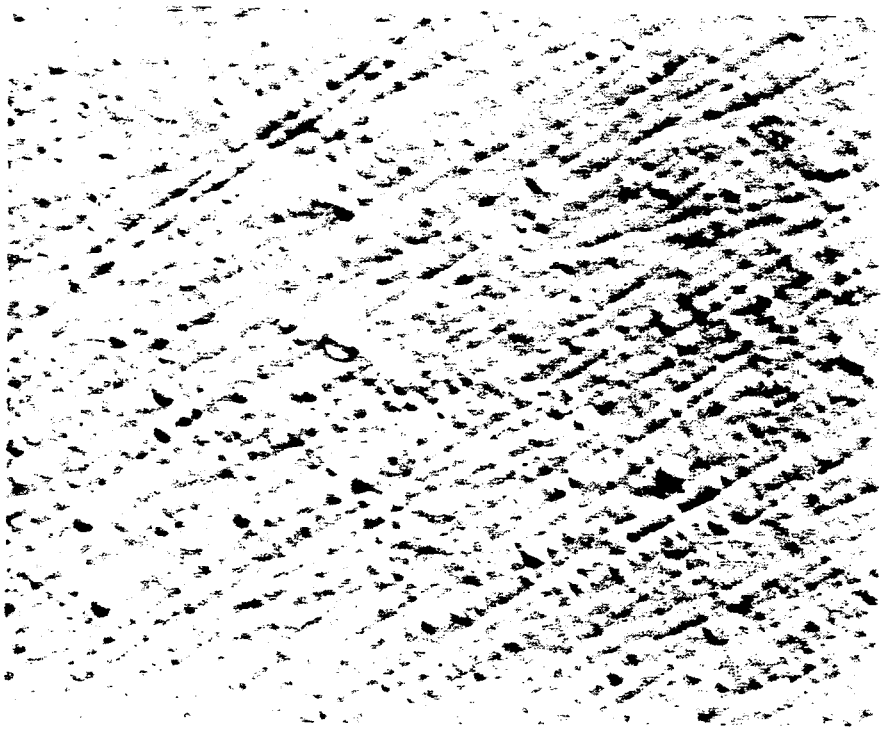

FIG. 2A shows the nickel surface resulting from using the above conventional double zincating procedure. When the same procedure was used except that ferric ions were added to the $HNO_3$ in step (5) at a level of 0.5 g/l, a markedly smoother nickel surface was obtained as shown by FIG. 2B.

EXAMPLE III

The procedure of EXAMPLE I (steps (1)-(4) were used to prepare a number of zincated CZ-46 aluminum alloy disks.

The disks were chosen at random and a total of 40 $ft^2$ were stripped at room temperature for each HNOhd 3 bath tested. The control $HNO_3$ was 50% by volume and was compared with the $HNO_3$ of the invention which was 50% by volume and containing 0.50 g/l ferric ions (supplied as ferric chloride).

Figure 3:
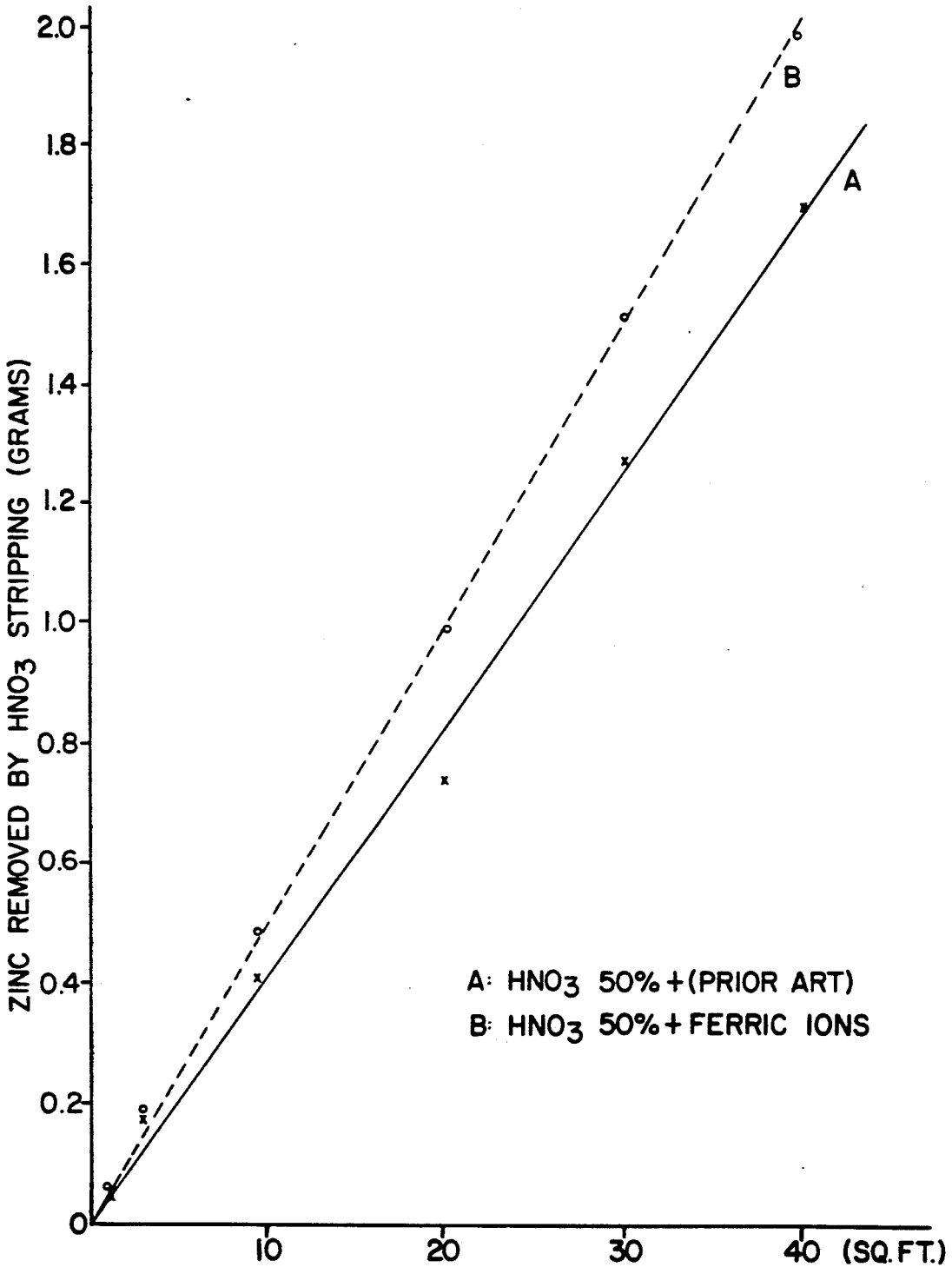
FIG. 3 is a graph showing that the nitric acid stripping solution of the invention (containing $Fe^{+++}$ ions) removes more zinc from a zincated aluminum substrate than a conventional zincate nitric acid solution.

FIG. 3 shows the amount of zinc coating removed per square feet of disk stripped and the results clearly show that the $HNO_3$ containing ferric ions removes more of the zinc coating than a conventional $HNO_3$ solution. This is important because less zinc is introduced to the plating solution.

EXAMPLE IV

This example demonstrates that less zinc is deposited on the substrate to be metal plated when using the double zincate method of the invention as compared to the conventional double zincate process.

CZ-46 aluminum alloy disks were treated using steps (1)-(4) of the procedure of EXAMPLE I. One group of the disks were randomly selected and immersed in a conventional $HNO_3$ solution (50% by volume) for 1 minute at room temperature. The other group were immersed in a 50% by volume $HNO_3$ solution containing 0.5 g/l ferric ions (supplied as ferric chloride) for the same length of time and temperature. The disks were then immersed in a second zincate bath (as in step (6) of EXAMPLE I) for either 10, 20, 30, 40, 50 or 60 seconds at room temperature. The zincated disks were then stripped in 50% by volume $HNO_3$ and the amount of zinc deposited on the disk determined by Atomic Absorbance Spectrophotometry.

Figure 4:
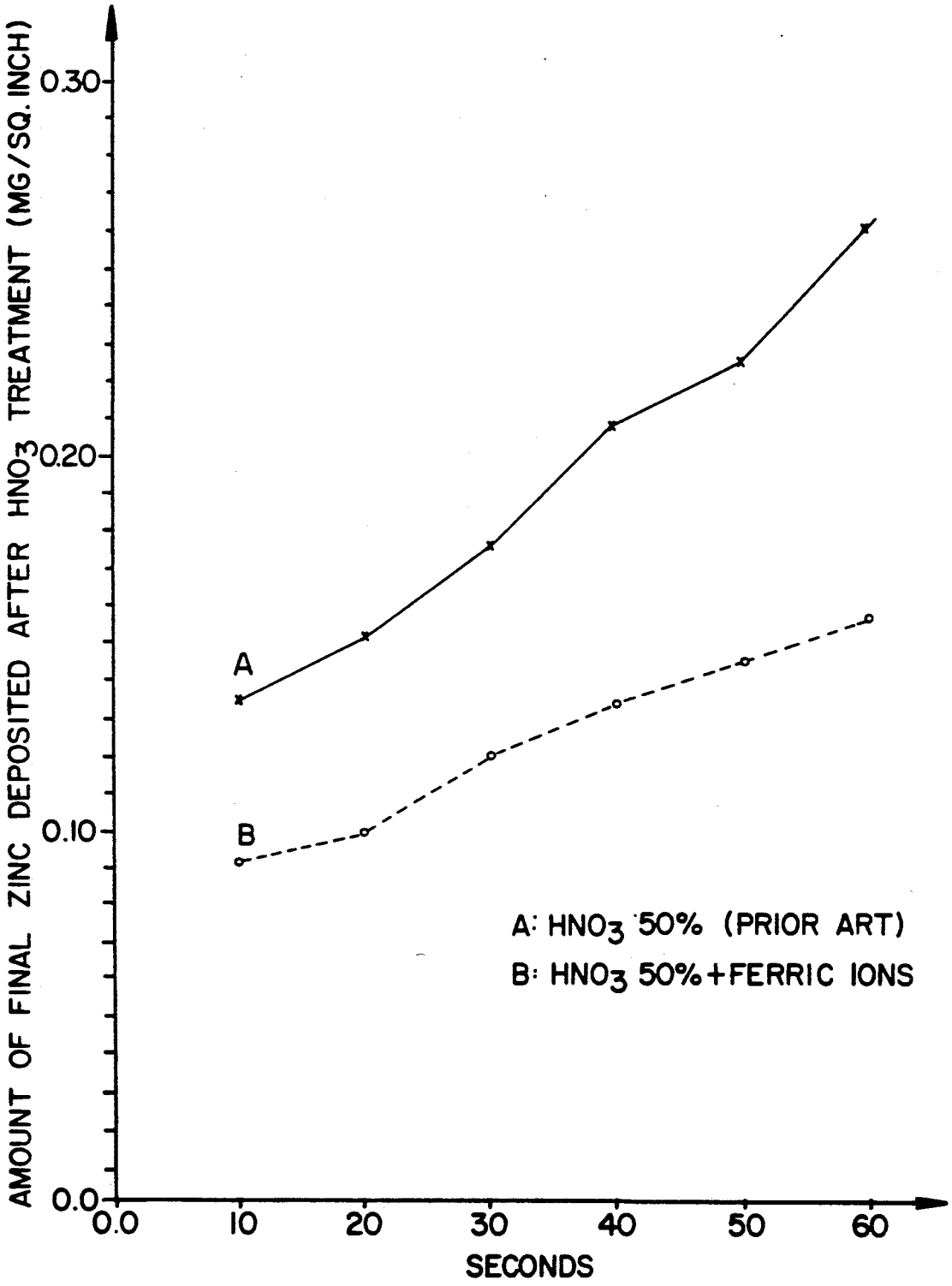
FIG. 4 is a graph showing that aluminum substrates prepared according to the invention have less zinc on the surface to be metal plated (a thinner coating) than substrates prepared using a conventional double zincate process.

FIG. 4 shows that less zinc was deposited on the disks when using the method of the invention as compared to the conventional double zincate method. This is important because there is less surface disturbance and consequently a thinner, but denser coating of zinc is obtained. The iron apparently acts as an inhibitor thus retarding and thereby controlling the dissolution of aluminum by zinc. Furthermore, the thinner deposits of zinc will not contaminate the subsequent electroless nickel bath as rapidly.

EXAMPLE IV

Aluminum 5586 alloy disks were comparatively plated using the procedures of EXAMPLE I to a thickness of about 0.40 mils. All the tests were run under the same plating conditions of 84° C., pH 4.6, a work load of 0.31 $ft^2$/gal., continuous filtration a plating time of 2 hours. The nickel, pH and sodium hypophosphite were continuously replenished over the 2 hour plating time using an automatic controller.

Figure 5A:
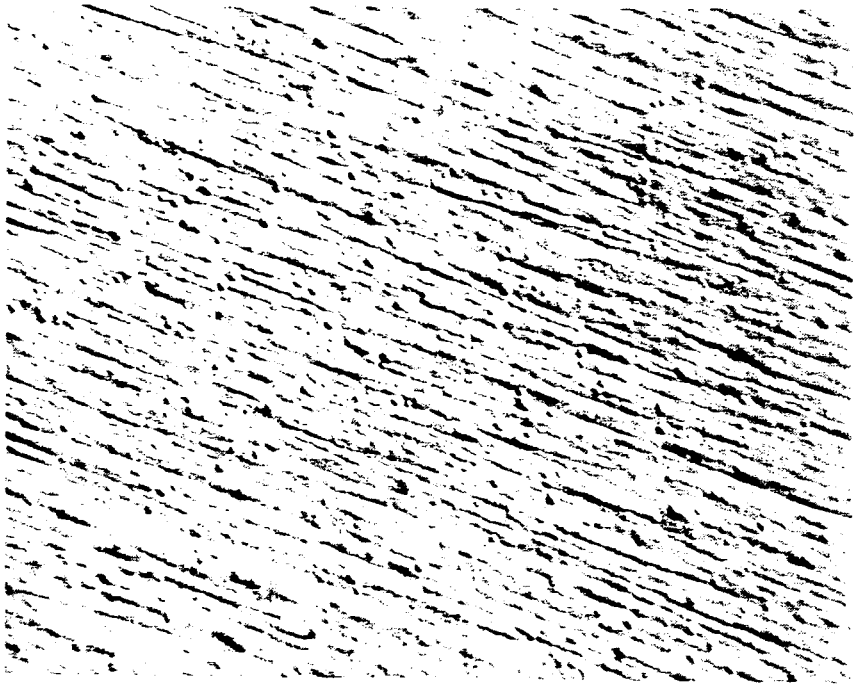
FIGS. 5A, 5B, 5C and 5D are photomicrographs at 500X of electrolessly nickel plated aluminum substrates using different zincating and plating procedures.

FIG. 5A represents the nickel surface resulting from using the above conventional zincating and plating procedure.

Figure 5B:
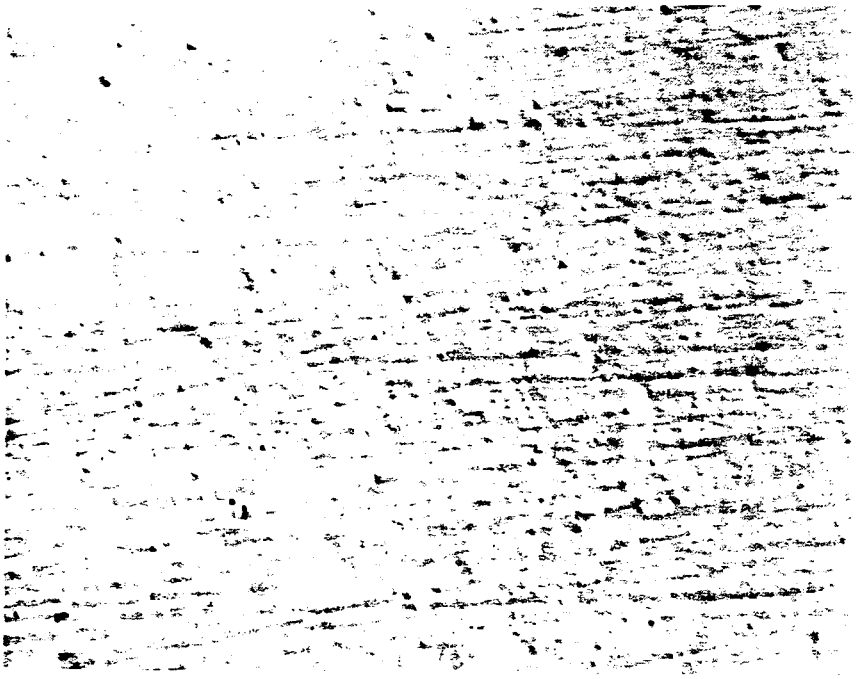

FIG. 5B represents the nickel surface resulting from using the above procedure with the exception that 0.5 g/l ferric ions (as ferric chloride) were added to the nitric acid (step (5)).

Figure 5C:
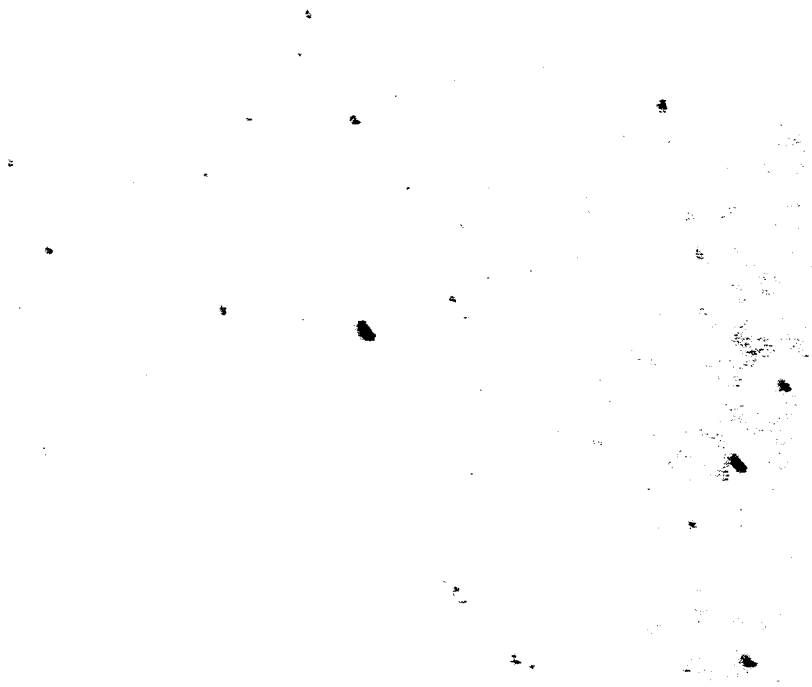

FIG. 5C represents the nickel surface resulting from the above procedure with the exception that 0.75 mg/l cadmium was added to the nickel plating bath before plating and not replenished during the 2 hour plating time.

Figure 5D:
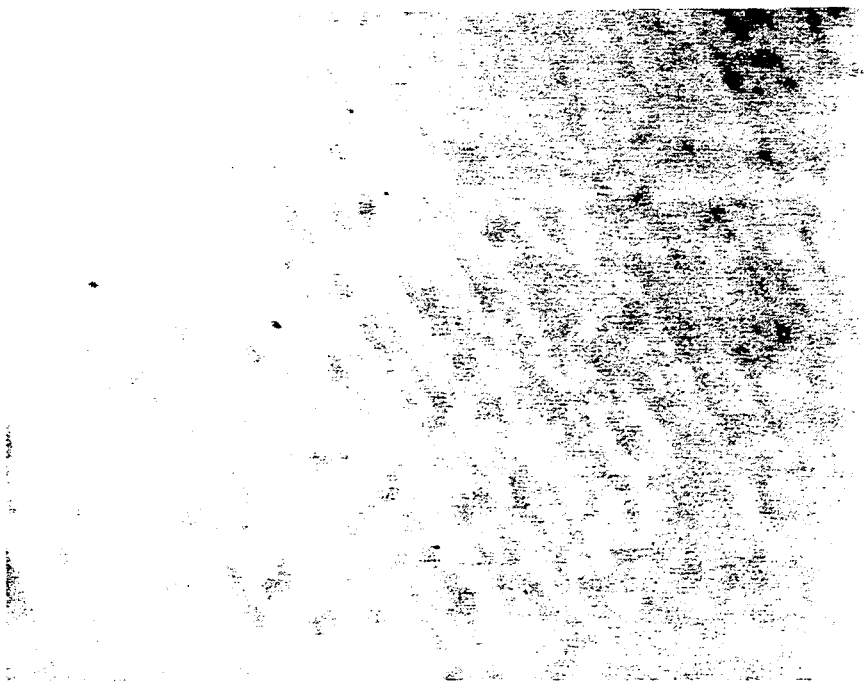

FIG. 5D represents the nickel surface resulting from using the above procedure with the exception that 0.5 g/l ferric (as ferric chloride) were added to the nitric acid (step 5) and 0.75 mg/l cadmium was added to the nickel plating bath and not replenished during the 2 hour plating time.

As can clearly be seen from the figures, the conventional process produces a rough surface having many nodules. FIGS. 5B and 5C show the beneficial effects of using ferric ions and cadmium, respectively and FIG. 5D shows the extremely smooth surface provided using the preferred method of the invention.

It will be apparent that many changes and modifications of the several features described herein may be made without departing from the spirit and scope of the invention. It is therefore apparent that the foregoing description is by way of illustration of the invention rather than limitation of the invention.

I claim:

1. A method for depositing a smooth electroless metal coating on an aluminum substrate comprising:
   (a) applying a zincate coating on the aluminum using a double zincate procedure wherein a nitric acid bath is used to treat the first zincate coated substrate the nitric acid bath initially consisting essentially of nitric acid and an added amount of a Group VIII ion in an amount of about 0.3–2 g/l; and
   (b) plating the zincated aluminum substrate using an electroless metal plating bath containing an effective amount of cadmium ions.

2. The method of claim 1 wherein the Group VIII ion is ferric ion.

3. The method of claim 2 wherein the cadmium is in an amount of about 0.1–1 g/l.

4. In the double zincating process for preparing aluminum and aluminum alloys for metal plating wherein the aluminum after pretreatment is zincated by immersion in a zincating bath, the zincated aluminum is then dipped in a nitric acid bath to remove the zincate coating, followed by immersion in a zincating bath to coat the aluminum and metal plating of the zincated aluminum, the improvement comprising employing a nitric acid bath that initially consists essentially of nitric acid and an added amount of a Group VIII ion in an amount of about 0.3–2 g/l.

5. The method of claim 4 wherein the Group VIII ion is selected from the group consisting of iron, cobalt and nickel.

6. The method of claim 5 wherein the Group VIII ion is ferric ion.

7. The method of claim 5 wherein the ferric ion is in an amount of about 0.3–1 g/l.

* * * * *